US008832939B2

(12) United States Patent
Wilson et al.

(10) Patent No.: US 8,832,939 B2
(45) Date of Patent: Sep. 16, 2014

(54) SPRING LATCH AND METHOD FOR ATTACHING A SEAT CUSHION TO A SEAT FRAME

(75) Inventors: Erik C Wilson, Decatur, IN (US); Samuel D Wagoner, Woodburn, IN (US); Patrick E Temple, Wapakoneta, OH (US); Eric DeView, Lansing, MI (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 179 days.

(21) Appl. No.: 13/583,346

(22) PCT Filed: Mar. 9, 2010

(86) PCT No.: PCT/US2010/026660

§ 371 (c)(1),
(2), (4) Date: Sep. 7, 2012

(87) PCT Pub. No.: WO2011/112183

PCT Pub. Date: Sep. 15, 2011

(65) Prior Publication Data

US 2013/0042479 A1 Feb. 21, 2013

(51) Int. Cl.

| | |
|---|---|
| ***B21D 53/88*** | (2006.01) |
| ***B23P 11/00*** | (2006.01) |
| ***A47C 31/00*** | (2006.01) |
| ***A47C 21/02*** | (2006.01) |

(52) U.S. Cl.
CPC ..... *A47C 21/022* (2013.01)
USPC ..... 29/897.2; 29/426.5; 29/446; 292/303; 24/458; 24/563; 297/218.5

(58) Field of Classification Search
USPC ..... 29/896.9, 896.91, 896.2, 897.2, 426.6, 29/446, 453; 292/253, 303; 24/457, 458, 24/545, 563; 297/218.1–218.3, 218.5, 297/463.1
See application file for complete search history.

(56) References Cited

U.S. PATENT DOCUMENTS

| | | | | |
|---|---|---|---|---|
| 2,755,846 | A | 7/1956 | Sheperdson | |
| 3,054,156 | A | 9/1962 | Cohen | |
| 3,599,918 | A | 8/1971 | Patchett | |
| 3,981,534 | A * | 9/1976 | Wilton | 297/218.1 |
| 4,630,338 | A | 12/1986 | Osterland et al. | |
| 4,746,168 | A | 5/1988 | Bracesco | |
| 5,573,378 | A * | 11/1996 | Barcza | 416/245 R |
| 5,605,373 | A * | 2/1997 | Wildern et al. | 297/218.4 |

* cited by examiner

*Primary Examiner* — Alexander P Taousakis
*Assistant Examiner* — Matthew P Travers
(74) *Attorney, Agent, or Firm* — Jeffrey P. Calfa; Mark C. Bach

(57) ABSTRACT

A method of attaching a seat cushion to a seat frame includes the steps of providing a spring latch having a spring portion and a brace portion, engaging a spring leg of the spring portion with the seat frame, attaching a cushion engaging leg of the brace portion to the seat cushion, and receiving a brace leg of the brace portion into a lock formation on a locking leg of the spring portion.

5 Claims, 2 Drawing Sheets

SPRING LATCH AND METHOD FOR ATTACHING A SEAT CUSHION TO A SEAT FRAME

BACKGROUND

Embodiments described herein relate to seat cushions for vehicles. More specifically, embodiments described herein relate to a spring latch and a method for attaching a seat cushion to a seat frame in a vehicle.

Typically, a seat for use in a bus is formed by attaching frame members together to form one or more sub-frames, such as a seat back sub-frame and a seat cushion sub-frame. When the sub-frames are assembled to form the seat frame, the seat cushion is attached to the seat frame. The seat frame is typically fixedly attached to the floor of the bus.

The seat cushion is secured to the seat frame with a mechanism that both positively retains the seat cushion onto the seat frame, and also permits the seat cushion to be readily pivotable from the seat frame, for example to pivot the seat cushion forward on a hinge for cleaning the seat. The mechanism should be easy to install, automatically latch the seat cushion onto the seat frame, and be of low cost to manufacture.

Typically, a twist lock mechanism is used to attach the seat cushion onto the seat frame. However, when installing the seat cushions onto the seat frame with a twist lock mechanism, the twist lock does not automatically latch the seat cushion onto the seat frame. Secondary steps have to be taken by the installer to ensure that the seat cushion is securely retained on the seat frame.

SUMMARY

Embodiments described herein relate to a spring latch for retaining a seat cushion to a seat frame and a method of attaching a seat cushion to a seat frame. In one embodiment, the spring latch comprises a spring portion having a general V-shape. The spring portion has a spring leg that engages the seat frame, and a locking leg disposed at an acute angle with respect to the spring leg. A brace portion forms a generally triangular shape with the locking leg, and the brace portion has a cushion engaging leg that attaches to the seat cushion.

Another embodiment provides a method of attaching a seat cushion to a seat frame that includes the steps of providing a spring latch having a spring portion and a brace portion, engaging a spring leg of the spring portion with the seat frame, attaching a cushion engaging leg of the brace portion to the seat cushion, and receiving a brace leg of the brace portion into a lock formation on a locking leg of the spring portion.

A further embodiment provides a spring latch for retaining a seat cushion to a seat frame. The spring latch comprises a spring leg having a frame engaging lip configured to engage the seat frame at a first end, and a locking leg extending from the spring leg at an acute angle from an end opposite from the frame engaging lip. The locking leg has a lock formation. A cushion engaging leg extends from the locking leg and is generally parallel to the seat cushion. The cushion engaging leg has an attachment formation for attaching the cushion engaging leg to the seat cushion. A brace leg extends from the cushion engaging leg at an acute angle. The brace leg has an end configured to be received in the lock formation.

DETAILED DESCRIPTION

Figure 1:
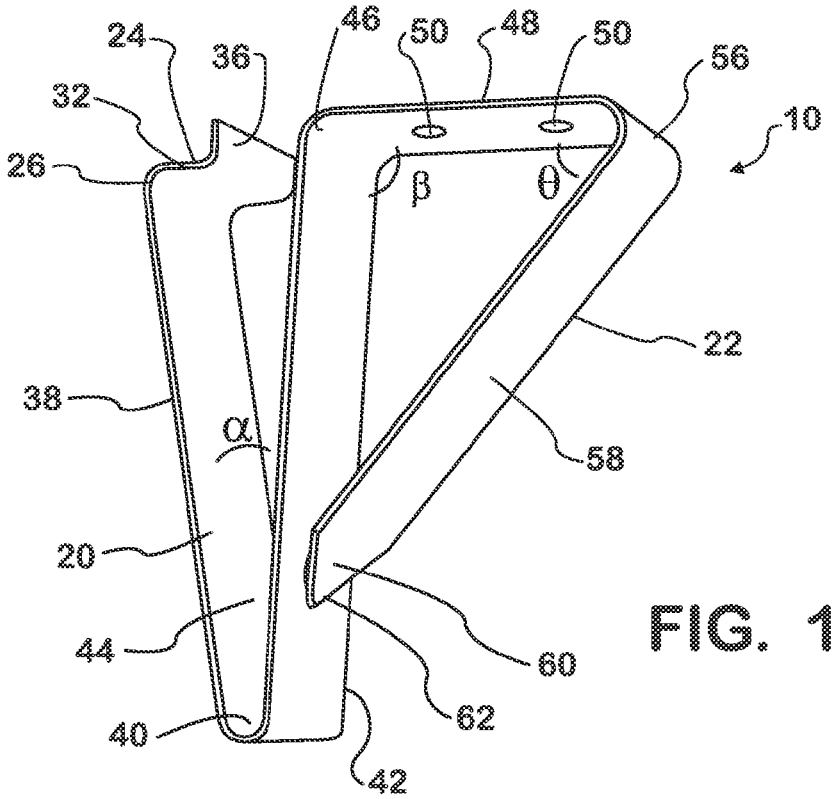
FIG. 1 is a perspective view of a spring latch.
Figure 2:
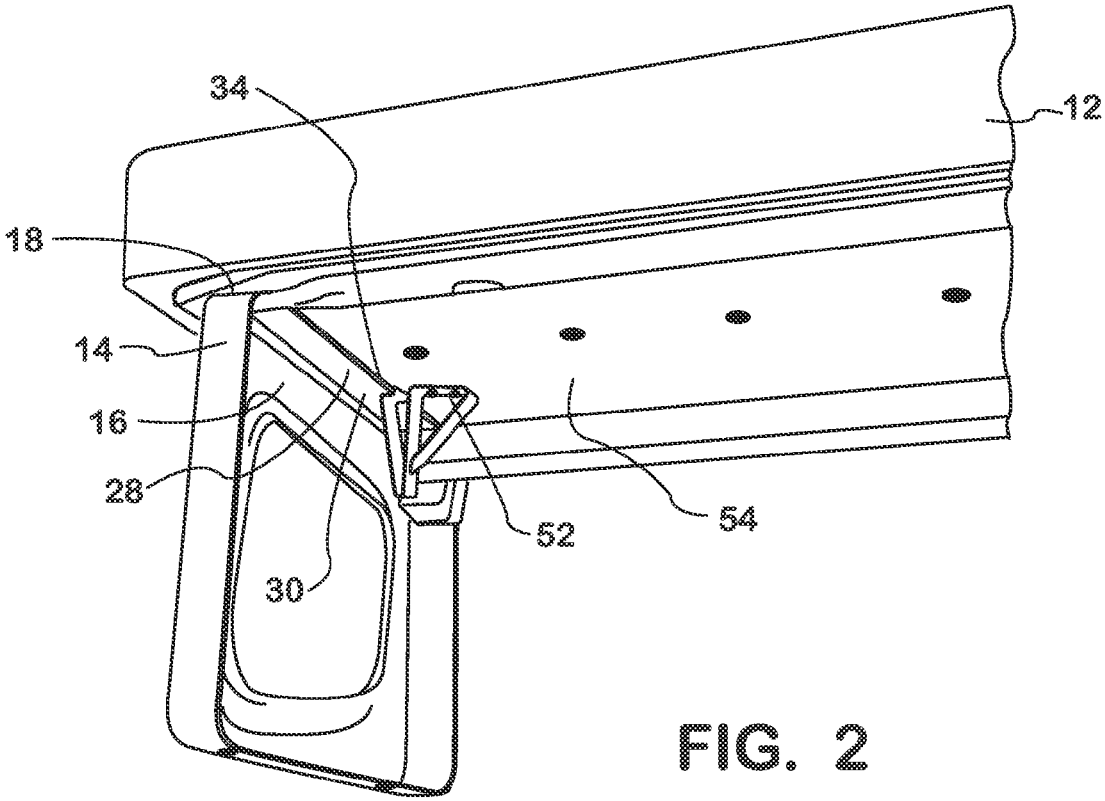
FIG. 2 is a perspective view of the spring latch retaining a seat cushion on a seat frame.

Referring now to FIGS. 1-2, a spring latch is indicated generally at 10 and is configured for attaching a seat cushion 12 to a seat frame 14 of a vehicle (not shown), such as a bus. The seat frame 14 includes one or more seat risers 16 that may be attached to a floor of a bus, and the seat cushion 12 is received on a top surface 18 of the seat risers.

The spring latch 10 is formed from a strip of metal, such as steel, and has a width of about 1-inch, however other materials and dimensions are possible. The spring latch 10 includes a spring portion 20 integrally formed with a brace portion 22. While the spring latch 10 has a one-piece construction, it is possible that the spring latch can be formed in multiple pieces.

The spring portion 20 is generally V-shaped and engages the seat riser 16 of the seat frame 14. A frame engaging lip 24 is located at a first end 26 of the spring portion 20. The frame engaging lip 24 is configured to engage a flange 28 of the seat riser 16 at a bottom surface 30 of the flange with a cantilever portion 32 of the frame engaging lip. The cantilever portion 32 is generally parallel with the seat cushion 12. A tab portion 36 of the frame engaging lip 24 is generally perpendicular to the seat cushion 12 and generally perpendicular to the cantilever portion 32. The tab portion 36 engages a distal surface 34 of the flange 28.

The frame engaging lip 24 is located at the first end 26 of a spring leg 38, and is an extension of the spring leg. Alternately, besides the lip-shaped formation of the frame engaging lip 24, the spring leg 38 can have any other configuration that engages the seat frame 14.

At an opposite end 40 of the spring leg 38 from the frame engaging lip 24, the spring leg extends at an acute angle $\alpha$ from a locking leg 42. When installed on a generally horizontal seat cushion 12, the locking leg 42 may be generally vertical. A lock formation 44, such as a receiving opening, is located on the locking leg 42.

Extending generally at a right angle $\beta$ from an end 46 of the locking leg 42 opposite from the spring leg 38 is the brace portion 22 of the spring latch 10. The brace portion 22 includes a cushion engaging leg 48 having at least one attachment formation 50, for example two spaced holes. It is possible that other attachment formations 50 may be used. In the spring latch 10, the attachment formation 50 receives at least one fastener 52 (FIG. 2) that may be introduced through the attachment formation and may be received in a bottom surface 54 of the seat cushion 12.

Extending from an end 56 of the cushion engaging leg 48 opposite from the locking leg 42 is a brace leg 58 of the brace portion 22. The brace leg 58 and the cushion engaging leg 48 form an acute angle $\theta$. A tongue 60 may be located at an end 62 of the brace leg 58 and may be tapered, rounded, pointed, or be any other shape configured for being received in the lock formation 44 on the locking leg 42.

Figure 3:
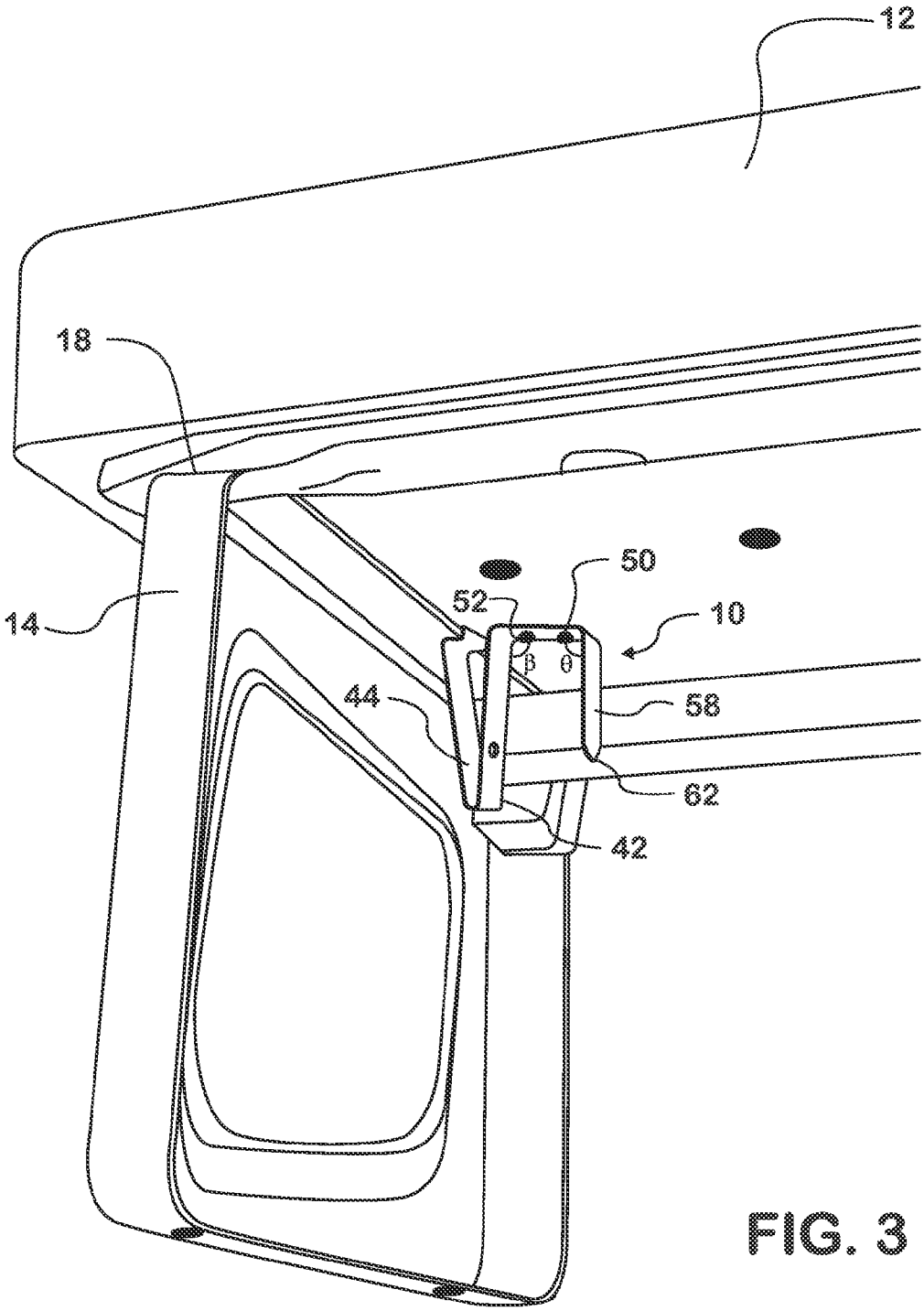
FIG. 3 is a perspective view of the spring latch attached to a seat cushion.

The spring latch 10 is attached to the seat cushion 12 and the seat cushion is positioned upon a top surface 18 of the seat frame 14. It is possible that when the spring latch 10 is attached to the seat cushion 12, as shown in FIG. 3, the end 62 of the brace leg 58 is not locked into the lock formation 44, but instead, the brace portion initially has an open shape. For example, the brace leg 58 is parallel to locking leg 42 before the locking feature is engaged. In other words, angles $\beta$ and $\theta$ may both be generally 90-degrees before the end 62 of the brace leg 58 is received into the lock formation 44. In this way, the installer has increased access to the attachment formation 50 and to the fasteners 52. After fastening the spring latch 10 to the seat cushion 12, the brace leg 58 can be received by the lock formation 44, for example by the user bending the spring latch 10.

When the brace portion 22 is attached to the seat cushion 12, the end 62 of the brace leg 58 is received in the lock formation 44, and the spring portion 20 is engaged with the seat frame 14, the spring latch 10 is automatically latched. When latched, the spring latch 10 prevents the vertical displacement of the seat cushion 12 from the seat frame 14.

To pivot or displace the seat cushion 12 from the seat frame 14, the user applies pressure on the spring portion 20, displacing the spring leg 38 towards the locking leg 42. The frame engaging lip 24 disengages from the seat frame 14, and the seat cushion 12 and the attached spring latch 10 can be pivoted from the top surface 18 of the seat frame 14.

What is claimed is:

1. A method of attaching a seat cushion to a seat frame, the method comprising the steps of:

providing a spring latch having a spring portion and a brace portion;

engaging a spring leg of the spring portion with the seat frame;

attaching a cushion engaging leg of the brace portion to the seat cushion; and receiving a brace leg of the brace portion into a lock formation on a locking leg of the spring portion wherein the step of attaching the cushion engaging leg of the brace portion to the seat cushion is prior to the step of receiving the brace leg of the brace portion into the lock formation.

2. The method of claim 1 further comprising the step of providing the spring portion with a generally V-shape.

3. The method of claim 1 further comprising the step of providing the brace portion with a generally triangular shape.

4. The method of claim 1 further comprising the step of displacing the spring leg towards a locking leg to disengage the spring leg from the seat frame to permit the seat cushion to be displaced from the seat frame.

5. The method of claim 1 wherein the spring leg has a frame engaging lip and the seat frame has a flange, further comprising the step of engaging the frame engaging lip with the flange on the seat frame.

* * * * *